US008300858B2

(12) United States Patent
Nakaya et al.

(10) Patent No.: US 8,300,858 B2
(45) Date of Patent: Oct. 30, 2012

(54) ELECTROSTATIC SPEAKER

(75) Inventors: Takao Nakaya, Hamamatsu (JP); Yasuaki Takano, Kikugawa (JP)

(73) Assignee: Yamaha Corporation, Hamamatsu-shi, Shizuoka-ken (JP)

( * ) Notice: Subject to any disclaimer, the term of this patent is extended or adjusted under 35 U.S.C. 154(b) by 795 days.

(21) Appl. No.: 12/210,771

(22) Filed: Sep. 15, 2008

(65) Prior Publication Data

US 2009/0087002 A1 Apr. 2, 2009

(30) Foreign Application Priority Data

Sep. 27, 2007 (JP) ..... P 2007-251158
May 20, 2008 (JP) ..... P2008-132235

(51) Int. Cl.

| | |
|---|---|
| ***H04R 25/00*** | (2006.01) |
| *H04R 1/00* | (2006.01) |
| *H04R 9/06* | (2006.01) |
| *H04R 11/02* | (2006.01) |

(52) U.S. Cl. ..... 381/189; 381/190; 381/401

(58) Field of Classification Search ..... 381/189, 381/190, 401

See application file for complete search history.

(56) References Cited

U.S. PATENT DOCUMENTS

| | | | | |
|---|---|---|---|---|
| 6,188,772 | B1 | 2/2001 | Norris | |
| 6,999,596 | B2 * | 2/2006 | Hiramoto et al. | 381/369 |
| 2007/0056377 | A1 | 3/2007 | Matsubara | |
| 2007/0274545 | A1 * | 11/2007 | Nakaya et al. | 381/191 |
| 2008/0064964 | A1 | 3/2008 | Nagata et al. | |

FOREIGN PATENT DOCUMENTS

| | | | |
|---|---|---|---|
| GB | 1318734 | A | 5/1973 |
| JP | 62-234000 | A1 | 10/1987 |
| JP | 2006166078 | A1 | 6/2006 |
| JP | 2007/060274 | A1 | 3/2007 |
| TW | 200726300 | | 7/2007 |
| WO | 2005/089645 | A1 | 9/2005 |

OTHER PUBLICATIONS

"<A&V Festa 2006 Report: 1-bit audio> Exhibition of 1-bit Distribution System Using IEEE 1394", http://www.phileweb.com/news/d-av/200609/21/16653.html, Sep. 2006, 1 page, Phile-web Editorial Department.

Taiwan Office Action relating to Taiwanese Patent Application No. 097135265, issued Jun. 11, 2012, Taiwan.

Japan Patent Office Action for Japanese Application No. 2008-132235, Aug. 7, 2012.

* cited by examiner

*Primary Examiner* — Lynne Gurley
*Assistant Examiner* — Vernon P Webb
(74) *Attorney, Agent, or Firm* — Smith Patent Office

(57) ABSTRACT

An electrostatic speaker is constituted of a vibrator, conductive cloths, and elastic members, which are laminated together and woven together using strings. Since all the constituent elements are restrained in positioning by strings, the overall structure thereof is not substantially changed even when the electrostatic speaker is deformed in shape by bending or curving, wherein it is possible to secure the prescribed positional relationship between the constituent elements, which are not deviated in positioning. It is possible to introduce a sheet composed of a thermoplastic resin, which holds the vibrator and elastic members therein. The conductive cloths can be replaced with film electrodes, each of which is formed such that a conductive polymer layer is formed on a base film composed of a thermoplastic resin.

12 Claims, 6 Drawing Sheets

ELECTROSTATIC SPEAKER

BACKGROUND OF THE INVENTION

1. Field of the Invention

The present invention relates to electrostatic speakers in which vibrators held between opposite electrodes vibrate in response to audio signals so as to generate sounds.

The present application claims priority on Japanese Patent Application No. 2007-251158 and Japanese Patent Application No. 2008-132235, the contents of which are incorporated herein by reference.

2. Description of the Related Art

Electrostatic speakers are constituted of opposite electrodes, which are distanced from each other with prescribed distances therebetween and which hold sheet-like vibrators (or vibrating members) having conductive properties therebetween. Due to variations of a voltage applied between opposite electrodes of an electrostatic speaker whose vibrator is supplied with a bias voltage, an electrostatic force exerted on the vibrator is varied so as to cause the displacement of the vibrator. Due to variations of the applied voltage in response to audio signals, displacements repeatedly occur in the vibrator causing vibration, thus generating reproduction waves from the vibrator in response to audio signals.

Various types of electrostatic speakers having flexibilities have been developed and disclosed in various documents such as Non-Patent Document 1 and Non-Patent Document 2.

Non-Patent Document 1: Technical Report of the Institute of Electronics, Information and Communication Engineers entitled "1-bit Wave Field Recording/Reproduction System Using Electrostatic Microphone and Loudspeaker" written by Shigeto Takeoka and five members, EA, Applied Acoustics, Institute of Electronics, Information and Communication Engineers, pp. 25-30, June of 2005

Non-Patent Document 2: <A & V Festa 2006 Report: 1-bit audio> exhibition of 1-bit distribution system using IEEE 1394: [online], Sep. 21, 2006, Phile-web editorial department: [Retrieval on Aug. 23, 2007]: Internet <http://www.phileweb.com/news/d-av/200609/21/16653.html>

Non-Patent Document 1 teaches a flexible electrostatic speaker including opposite electrodes and a vibrator, which are composed of flexible materials having the capabilities to change shapes. Non-Patent Document 2 teaches an electrostatic speaker in which electrodes are composed of flexible cloth.

Both of Non-Patent Document 1 and Non-Patent Document 2 teach edgeless flexible electrostatic speakers in which electrodes and vibrators are not restrained in shapes. Since the flexible electrostatic speaker disclosed in Non-Patent Document 1 is not restrained in shape, it can be freely bent and curved and thus changed into various shapes. However, such a non-restraint property of the electrostatic speaker causes another problem in that electrodes and vibrators may be easily deviated in positioning.

SUMMARY OF THE INVENTION

It is an object of the present invention to provide an electrostatic speaker having flexibility, which can be easily bent or curved without causing positional deviations of electrodes and a vibrator.

An electrostatic speaker of the present invention is constituted of a first electrode corresponding to a cloth formed using conductive fibers, a second electrode corresponding to a cloth formed using conductive fibers, which is positioned opposite to the first electrode with a prescribed distance therebetween, a vibrator having a conductive property, which is positioned between the first electrode and the second electrode, a first elastic member having an insulating property, elasticity, and acoustic transmittance, which is positioned between the vibrator and the first electrode, a second elastic member having an insulating property, elasticity, and acoustic transmittance, which is positioned between the vibrator and the second electrode, and a restraint member for restraining the first electrode, the first elastic member, the vibrator, the second elastic member, and the second electrode in position.

In the above, the restraint member corresponds to a plurality of strings for weaving the first electrode, the first elastic member, the vibrator, the second elastic member, and the second electrode together. The first electrode and the second electrode can be formed by weaving conductive strings. The first electrode and the second electrode can be woven with flexibilities. The first electrode and the second electrode can be woven together while being stretched.

In addition, the area of the first electrode is larger than the area of the vibrator, and the area of the second electrode is larger than the area of the vibrator.

The restraint member corresponds to a plurality of tag-pins which run through the first electrode, the first elastic member, the vibrator, the second elastic member, and the second electrode.

The restraint member is a sheet composed of a thermoplastic resin, which is positioned between the first electrode and the vibrator and between the vibrator and the second electrode, and wherein when the sheet is melted, the first electrode and the vibrator are adhered together, while the vibrator and the second electrode are adhered together.

It is possible to further introduce a first quilting member which is positioned opposite to the first elastic member in view of the first electrode and a second quilting member which is positioned opposite to the second elastic member in view of the second electrode, wherein both the first quilting member and the second quilting member are restrained by the restraint member.

As described above, the electrostatic speaker can be freely bent or curved in shape, wherein all the constituent elements are not deviated in positioning without causing substantial variations of the distance between the electrodes (e.g., conductive cloths). Even when the electrostatic speaker is bent, it is possible to maintain substantially the constant distance between the electrodes (and the constant distances between the vibrator and the electrodes, whereby it is possible to set the uniform electrostatic force exerted on the vibrator at any positions, thus achieving desired acoustic characteristics.

BRIEF DESCRIPTION OF THE DRAWINGS

These and other objects, aspects, and embodiments of the present invention will be described in more detail with reference to the following drawings.

DESCRIPTION OF THE PREFERRED EMBODIMENT

The present invention will be described in further detail by way of examples with reference to the accompanying drawings.

Figure 1:
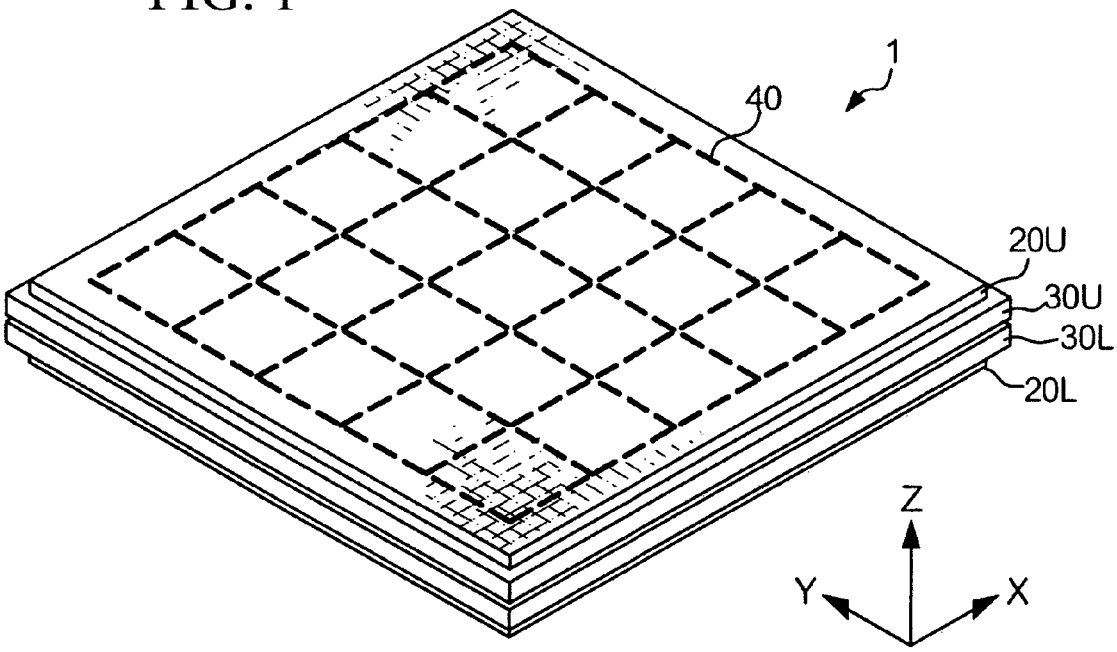
FIG. 1 is a perspective view showing the exterior appearance of an electrostatic speaker in accordance with a preferred embodiment of the present invention.
Figure 2:
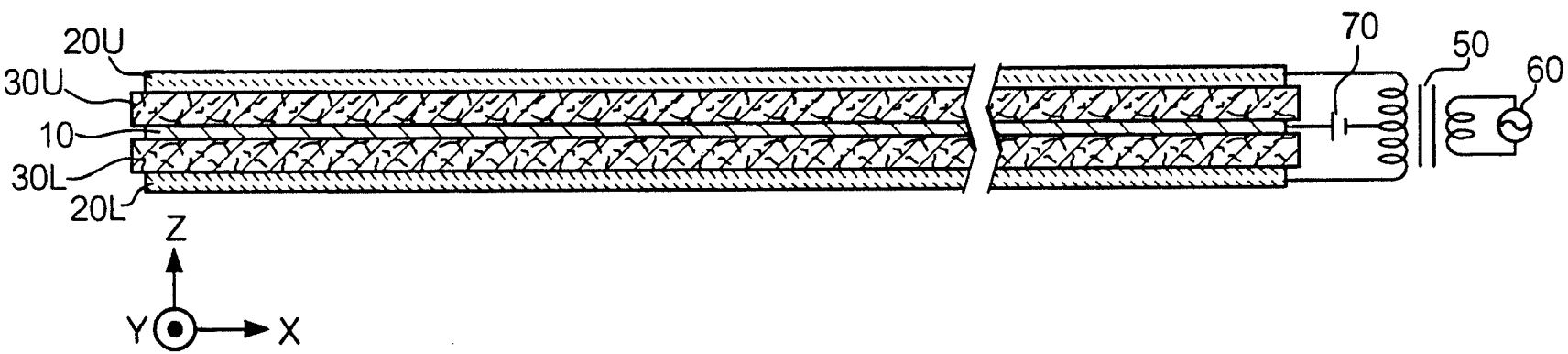
FIG. 2 is a longitudinal sectional view showing the electronic configuration of the electrostatic speaker constituted of a vibrator, conductive cloths, elastic members, and strings in connection with a transformer, an input unit, and a bias voltage source.

FIG. 1 diagrammatically shows the exterior appearance of an electrostatic speaker 1 in accordance with a preferred embodiment of the present invention. FIG. 2 shows the electronic configuration and sectional configuration of the electrostatic speaker 1.

The electrostatic speaker 1 is constituted of a vibrator 10, conductive cloths 20U and 20L, elastic members 30U and 30L, and strings 40. In the present embodiment, both the conductive cloths 20U and 20L have the same constitution, and both the elastic members 30U and 30L have the same constitution. For the sake of convenience, both the reference numerals 20U and 20L are designated by the same reference numeral "20", and both the reference numerals 30U and 30L are designated by the same reference numeral "30". To simplify the illustrations in a visually easy-to-grasp manner, the aforementioned constituent elements are not precisely illustrated in the drawings in terms of the shapes and dimensions; hence, they may differ from the actually produced elements for use in products. In this connection, FIG. 1 is a three-dimensionally illustrated drawing along with X, Y, and Z axes, while FIG. 2 is a drawing along with X and Z axes in view of the Y-axis (which is designated by a circle having a dot indicating that the Y-axis is directed from the backside of the sheet).

Next, the constitution of the electrostatic speaker 1 will be described in detail. The vibrator 10 is formed using a film (or films) composed of PET (Polyethylene Terephthalate) or PP (Polypropylene), which is deposited with metal films or which is applied with conductive materials, wherein the thickness thereof substantially ranges from several micrometers to several tens of micro-meters (μm).

The elastic member 30 having elasticity is formed in a rectangular shape in plan view by heating and compressing soft cotton so as to allow air to transmit therethrough. The elastic member 30 is deformable due to an external force applied thereto and is restored in shape by eliminating the external force. In the present embodiment, the lengths of the elastic member 30 are longer than the lengths of the conductive cloth 20 (having a rectangular shape) in the X-axis and Y-axis directions. In addition, the lengths of the elastic member 30 are longer than the lengths of the vibrator 10 in the X-axis and Y-axis directions. Both the elastic members 30U and 30L have the same height in the Z-axis direction.

The conductive cloths 20 each formed in a rectangular shape in plan view are plain woven cloths woven using longitudinal strings and latitudinal strings having conductive properties. The plain woven cloths transmit air therethrough, thus securing acoustic transmittances.

The vibrator 10, the conductive cloths 20, and the elastic members 30 are woven together using the strings 40, which are composed of non-conductive cotton.

Next, the assembling of the electrostatic speaker 1 will be described in detail. In the assembling of the electrostatic speaker 1, the elastic member 30L is mounted on the conductive cloth 20L in such a way that all the side portions of the elastic member 30L are positioned outside of all the side portions of the conductive cloth 20L.

Next, the vibrator 10 is mounted on the elastic member 30L in such a way that all the side portions of the vibrator 10 are positioned inwardly of all the side portions of the elastic member 30L.

Then, the elastic member 30U is mounted on the vibrator 10 in such a way that all the side portions of the elastic member 30U are positioned outside of all the side portions of the vibrator 10 while the four corners of the elastic member 30U vertically match the four corners of the elastic member 30L in positioning in view of the Z-axis direction. Since the lengths of the elastic members 30U and 30L are longer than the lengths of the vibrator 10 in the X-axis and Y-axis directions, the vibrator 10 is entirely held between the elastic members 30U and 30L in such a way that all the side portions of the vibrator 10 are not positioned outside of the elastic members 30U and 30L.

Next, the conductive cloth 20U is mounted on the elastic member 30U in such a way that all the side portions of the conductive cloth 20U are positioned inwardly of all the side portions of the elastic member 30U while four corners of the conductive cloth 20U vertically match four corners of the conductive cloth 20L in positioning in view of the Z-axis direction.

After combining the vibrator 10, the conductive cloths 20, and the elastic members 30 together, they are woven together using the non-conductive strings 40. Since all the constituent elements 10, 20, and 30 are restrained in positioning since they are woven together using the strings 40 (which run through the constituent elements 10, 20, and 30), it is possible to prevent the vibrator 10, the conductive cloths 20, and the elastic members 30 from being deviated in positioning even when the electrostatic speaker 10 is deformed in shape.

Since the areas of the elastic members 30 having insulating properties are larger than the area of the vibrator 10 and the areas of the conductive clothes 20, the side portions of the elastic members 30 are positioned outside of the side portions of the vibrator 10 and the side portions of the conductive clothes 20; hence, it is possible to prevent the conductive cloths 20 from unexpectedly coming in contact with and short-circuiting with the vibrator 10.

Next, the electronic constitution of the electrostatic speaker 1 will be described in detail. FIG. 2 shows an equivalent circuit in which the electrostatic speaker 1 is connected with a transformer 50, an input unit 60 (for inputting audio signals from an external device, not shown), and a bias voltage source 70 (for applying a DC bias voltage to the vibrator 10). The bias voltage source 70 is connected between the vibrator 10 and a midpoint of the transformer 50, wherein the conductive cloths 20U and 20L are connected to the opposite ends of the transformer 50. In this constitution, a predetermined voltage is applied to the conductive clothes 20U and 20L in response to audio signals applied to the input unit 60.

The applied voltage causes a potential difference between the conductive cloths 20U and 20L, by which an electrostatic force is exerted on the vibrator 10, which is thus attracted to one of the conductive cloths 20U and 20L (serving as electrodes). That is, the vibrator 10 is displaced (or deflected) in the Z-axis direction in response to audio signals, wherein the displacement direction of the vibrator 10 is successively varied so as to cause vibration (having a certain frequency, amplitude, and phase). This makes it possible for the electrostatic speaker 1 to generate sound due to the vibration of the vibrator 10. At least one of the conductive cloths 20U and 20L propagate the generated sound, which is thus emitted to the external space of the electrostatic speaker 1.

The present embodiment is characterized in that all the constituent elements of the electrostatic speaker 1, i.e. the vibrator 10, the conductive cloths 20, and the elastic members 30, are restrained in positioning due to the strings 40; hence, even when the electrostatic speaker 1 is deformed in shape, the original structure and constitution are not affected so that the vibrator 10, the conductive cloths 20, and the elastic members 30 are not deviated in positioning.

Since all of the vibrator 10, the conductive cloths 20, and the elastic members 30 have flexibilities, they can be easily and freely deformed along with curved surfaces. Thus, it is possible to freely attach the electrostatic speaker 1 to clothing.

Due to the flexibilities of the constituent elements of the electrostatic speaker 1, the electrostatic speaker 1 may not damage the human body irrespective of a collision with the human body. For this reason, it is possible to easily attach the electrostatic speaker 1 to a head rest or the inside of a full-face helmet without damaging the human body in generating sound towards human ears.

The present embodiment can be modified in a variety of ways; hence, variations will be described below.

As shown in FIG. 2, the electrostatic speaker 1 of a first variation is constituted of the vibrator 10, the conductive cloths 20, the elastic members 30, and the strings 40 as well as the transformer 50, the input unit 60, and the bias voltage source 70.

Figure 3A:
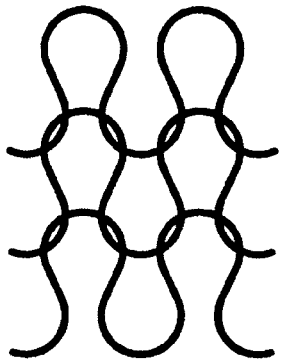
FIG. 3A shows knitting of strings for use in the formation of a conductive cloth.
Figure 3B:
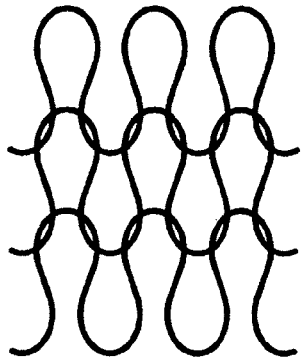
FIG. 3B shows rib knitting of strings for use in the formation of a conductive cloth.
Figure 3C:
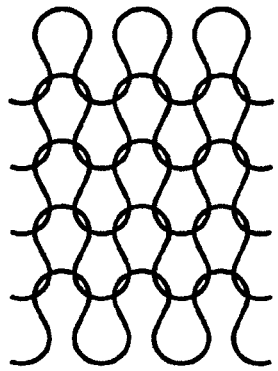
FIG. 3C shows pearl knitting of strings for use in the formation of a conductive cloth.

The first variation is characterized in that the conductive cloths 20U and 20L are not plain-woven cloth (woven using conductive strings) but knitted fabrics (knitted using conductive strings) as shown in FIG. 3A. The conductive cloths 20 corresponding to knitted fabrics have flexibilities in both the X-axis and Y-axis directions. The conductive cloths 20 are not necessarily limited to knitted fabrics as long as they have flexibilities in both the X-axis and Y-axis directions. For example, they can be formed by rib knitting as shown in FIG. 3B, or they can be formed by pearl knitting as shown in FIG. 3C.

The first variation of the electrostatic speaker 1 is assembled by sequentially laminating the conductive cloth 20L, the elastic member 30L, the vibrator 10, the elastic member 30U, and the conductive cloth 20U, which are then woven together using the strings 40. In the first variation, the conductive cloths 20U and 20L are woven together in the condition where they are slightly expanded (or stretched) in the X-axis and Y-axis directions.

Figure 4A:
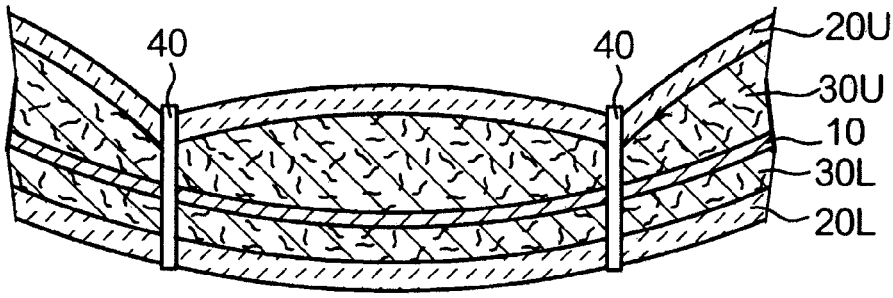
FIG. 4A is a sectional view showing that the inner portions of a conductive cloth corresponding to plain woven cloth become loosened when the electrostatic speaker is deformed in a circular manner.
Figure 4B:
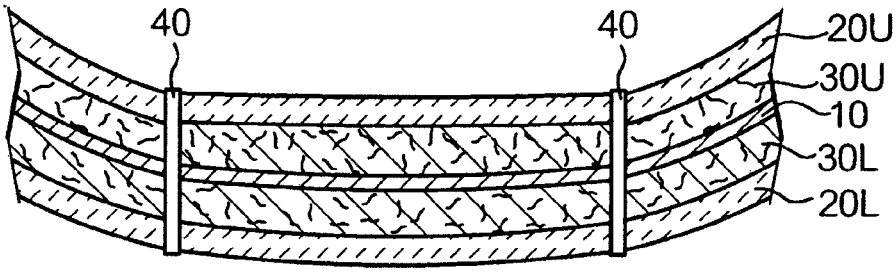
FIG. 4B is a sectional view showing that the inner portions of a conductive cloth corresponding to knitted fabrics do not become loosened even when the electrostatic speaker is deformed in a circular manner.

Compared with knitted fabrics, plain woven cloth has low flexibility; therefore, when the electrostatic speaker 1, in which plain woven cloth is used as the conductive cloths 20 and is woven together without being expanded (or stretched), is deformed in a circular manner, for example, the inner portions (which are not woven using the strings 40) of the conductive cloths 20 may become partially loosened as shown in FIG. 4A, and it is difficult to maintain a constant distance between the conductive cloths 20.

In the first variation, the conductive cloths 20 are woven together while they are stretched in the X-axis and Y-axis directions; hence, even when the electrostatic speaker 1 is deformed in a circular manner, the inner portions of the conductive cloths 20 (which are stretched in weaving) may be contracted so that they do not become loosened, while the external portions of the conductive cloths 20 (corresponding to knitted fabrics) having flexibilities may be expanded so as to maintain the constant distance between the conductive cloths 20.

In the first variation, the conductive cloths 20 corresponding to knitted fabrics have flexibilities due to gaps intentionally formed between longitudinal strings and latitudinal strings; hence, compared with plain woven cloth, it is possible to improve air transmittance and acoustic transmittance.

Figure 5:
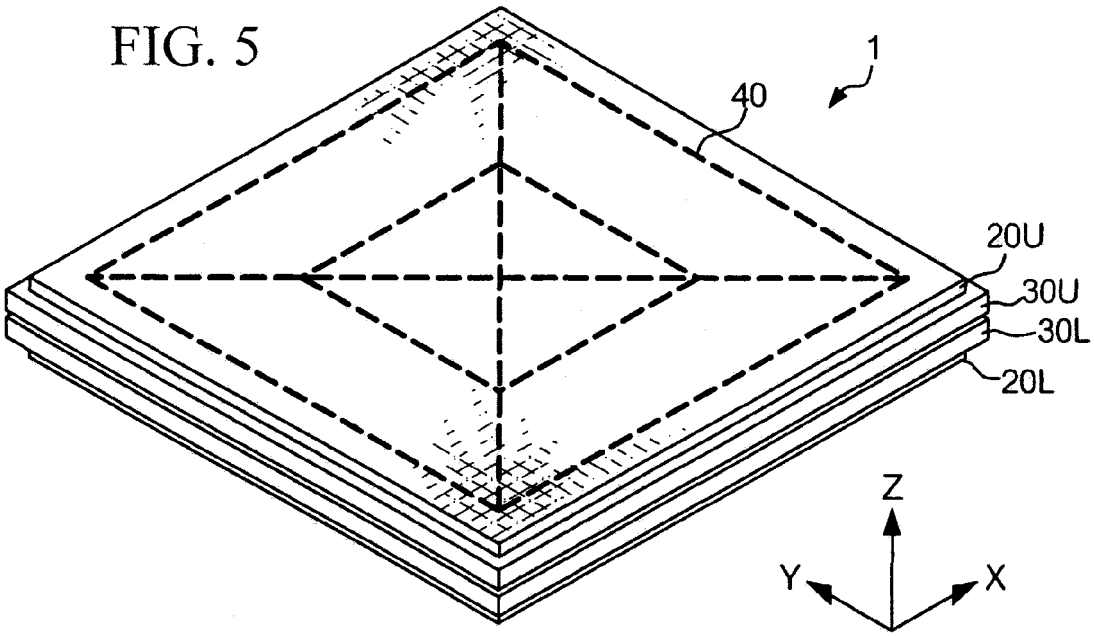
FIG. 5 is a perspective view showing a variation of the electrostatic speaker in which stitches are not aligned along rectangular lines but are aligned along diagonal lines.

FIG. 5 shows a second variation of the electrostatic speaker 1 in which stitches are not aligned along rectangular lines but are aligned along diagonal lines.

The elastic members 30 are not necessarily composed of soft cotton but can be composed of other materials having insulating properties and deformable properties, in which they are deformed under an external force applied thereto but are restored in shape by eliminating the external force.

The constituent elements of the electrostatic speaker 1 such as the vibrator 10, the conductive cloths 20, and the elastic members 30 are not necessarily formed in rectangular shapes but can be formed in other shapes such as polygonal shapes, circular shapes, and elliptical shapes.

In order to avoid the occurrence of electric shock and short-circuiting, it is possible to entirely cover the electrostatic speaker 1 with non-conductive cloth having acoustic transmittance.

The conductive cloths 20 can be formed using longitudinal strings and latitudinal strings, at least one of which has the conductive property.

All of longitudinal strings and latitudinal strings do not necessarily have conductive properties; that is, the conductive cloths 20 may include every other string(s) having conductive property.

Alternatively, non-conductive strings are knitted so as to form knitted cloth, which is then plated with metals having conductive properties, thus forming the conductive cloths 20.

Alternatively, strings plated with metals having conductive properties are woven together so as to form the conductive cloths 20.

The conductive cloths 20 can be formed by weaving conductive filaments therein.

It is possible to use strings whose cores are wound by copper foils plated with tin, which are woven together so as to form the conductive cloths 20.

The conductive cloths 20 can be replaced with non-woven fabrics having conductive properties.

Knitted cloth, which is formed by way of knitted weaving using strings having insulating properties, is bonded together with mesh cloth, which is formed by way of mesh weaving using strings having conductive properties, via bonding agents, thus forming the conductive cloths 20. Herein, the mesh cloth of the conductive cloths 20 is laminated with the elastic members 30; then, they are woven together using the strings 40 so as to form the electrostatic speaker 1.

Alternatively, the knitted cloths are directed outwardly so that the mesh clothes are positioned between the knitted cloths and the elastic members 30; then, they are woven together so as to form the electrostatic speaker 1.

In the structure in which the knitted cloths are not bonded with the mesh cloths, all the constituent elements of the electrostatic speaker 1 are woven together using the strings 40 in the condition where the knitted cloths are stretched.

Figure 6:
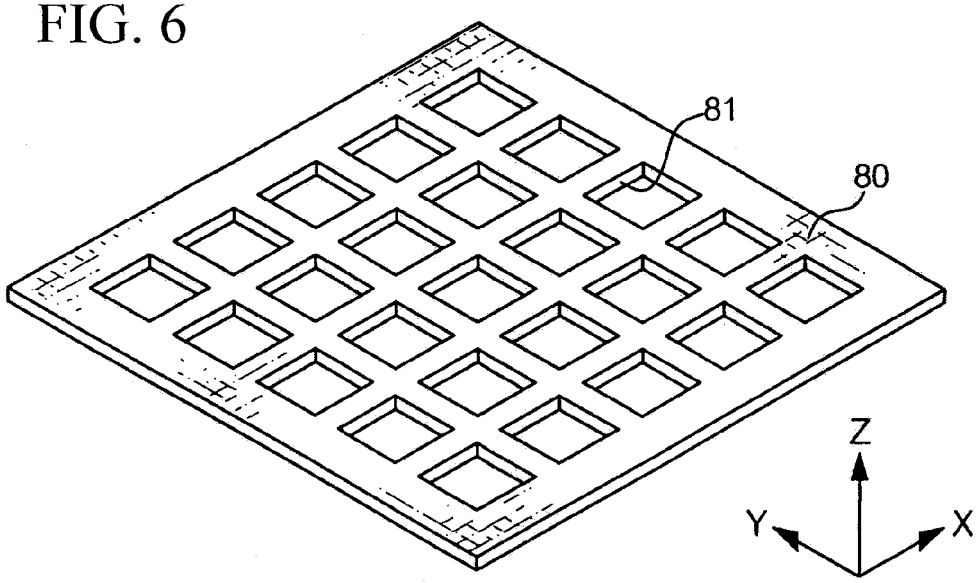
FIG. 6 is a perspective view showing a non-woven fabric member for reinforcing the electrostatic speaker.

In order to secure adequate strengths of the constituent elements woven together by the strings 40, it is possible to introduce a non-woven fabric member 80 having a mesh-like shape and a plurality of holes 81 as shown in FIG. 6. The non-woven fabric member 80 is inserted between the conductive cloths 20 and the elastic member 30; then, the rectangular portions (corresponding to meshes) of the non-woven fabric member 80 are woven together with the conductive cloths 20 and the elastic member 30 by use of the strings 40.

In the foregoing embodiment, the vibrator 10, the conductive cloths 20, and the elastic members 30 are woven together using the strings 40, which can be replaced with tag-pins (composed of a synthetic resin), by which the constituent element 10-30 are restrained in positioning. When the constituent elements 10-30 are restrained in position by use of multiple tag-pins, it is possible to prevent the constituent elements 10-30 from being shifted in position even when the constituent elements 10-30 are deformed in shape. That is, the adhesion using the sheets 90 demonstrates an outstanding effect as similar to the weaving using the strings 40.

Figure 7A:
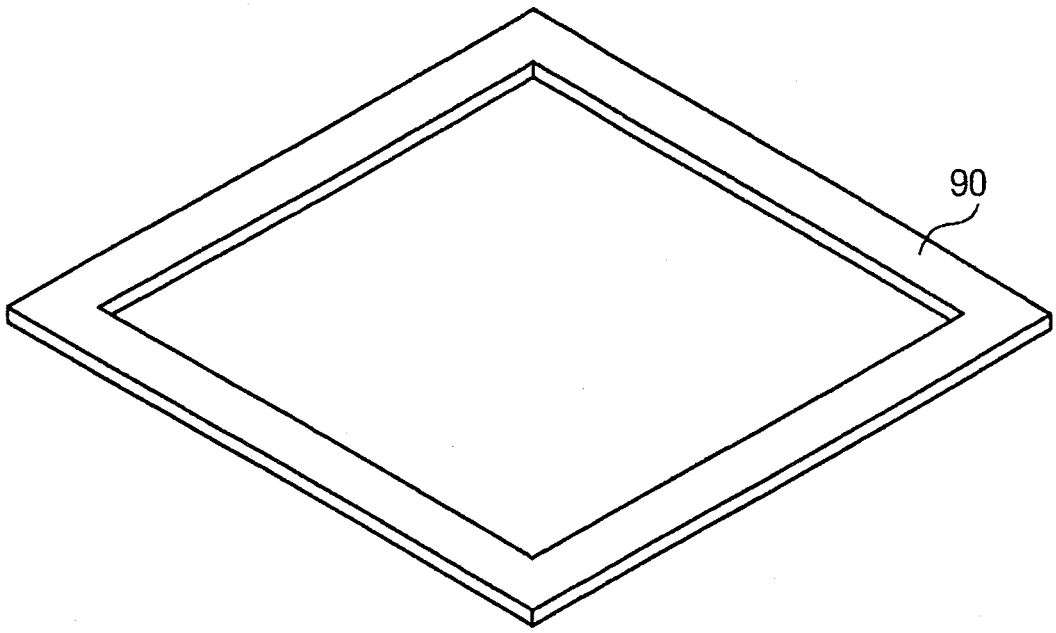
FIG. 7A is perspective view showing a sheet composed of a thermoplastic resin used for the adhesion of the constituent elements.

It is possible to additionally introduce a plurality of sheets 90 each composed of a thermoplastic resin and having a rectangular shape in plan view as shown in FIG. 7A between the constituent elements 10-30. The sheets 90 are pressed and heated and then cooled so as to restrain the constituent elements 10-30 in position.

Specifically, the sheet 90 is inserted between the conductive cloth 20U and the elastic member 30U; the sheet 90 is inserted between the elastic member 30U and the vibrator 10; the sheet 90 is inserted between the vibrator 10 and the elastic member 30L; and the sheet 90 is inserted between the elastic member 30L and the conductive cloth 20L. Then, the prescribed portions of the constituent elements 10-30 accompanied with the sheets 90 are pressed and heated, whereby the sheets 90 each composed of a thermoplastic resin are melted so as to adhere the constituent elements 10-30 together.

Since the constituent elements 10-30 are adhered together by way of melting of the sheets 90, it is possible to prevent them from being shifted in position. That is, the adhesion using the sheets 90 demonstrates an outstanding effect as similar to the weaving using the strings 40.

Figure 7B:
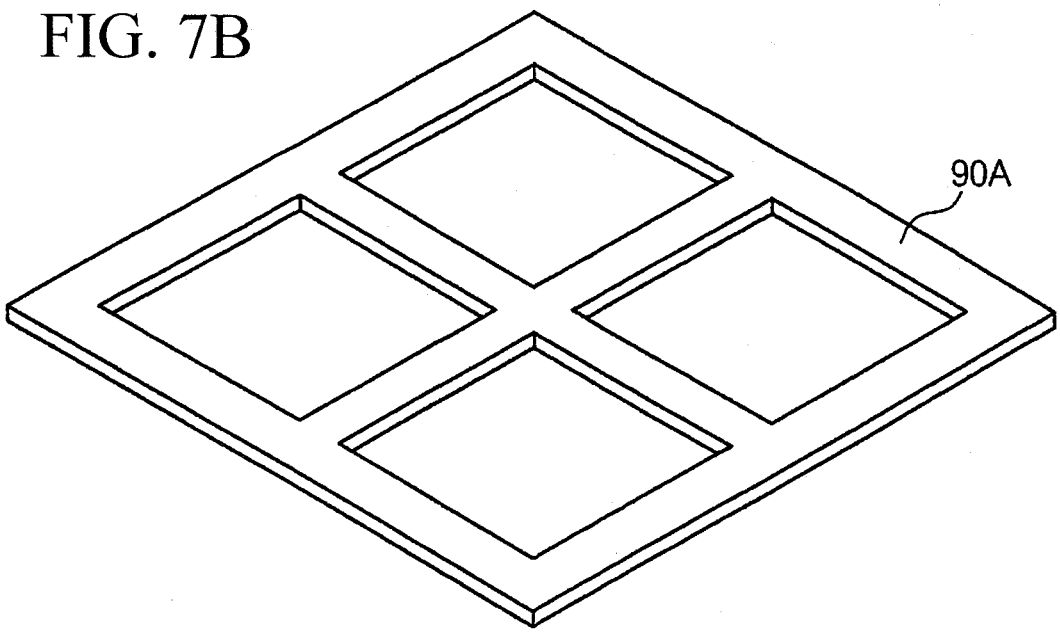
FIG. 7B is a perspective view showing a lattice sheet used for the adhesion of the constituent elements.

The sheet 90 is not necessarily formed in a rectangular frame-like shape; hence, it is possible to introduce a lattice sheet 90A shown in FIG. 7B.

In the above, it is possible to appropriately determine the shapes and dimensions of the vibrator 10 and the elastic members 30, which can be held inside of the rectangular frame of the sheet 90. Specifically, the sheet 90 is mounted on the conductive cloth 20L; then, a set of the vibrator 10 and the elastic members 30L and 30U is held inside of the rectangular frame of the sheet 90; thereafter, the conductive cloth 20U is mounted on the elastic member 30U and the sheet 90. Thereafter, the sheet 90 is pressed and heated so as to adhere the conductive cloths 20U and 20L together via the sheet 90. In this structure, the vibrator 10 and the elastic members 30 are held inwardly of the conductive cloths 20 and the sheet 90; thus, it is possible to prevent the vibrator 10 and the elastic members 30 from being exposed externally.

It is possible to replace the conductive cloths 20 with film electrodes (not shown), each of which is composed of a thermoplastic resin and is formed in such a way that a conductive polymer is applied to the internal area internally of the edges of the thermoplastic resin.

Figure 8:
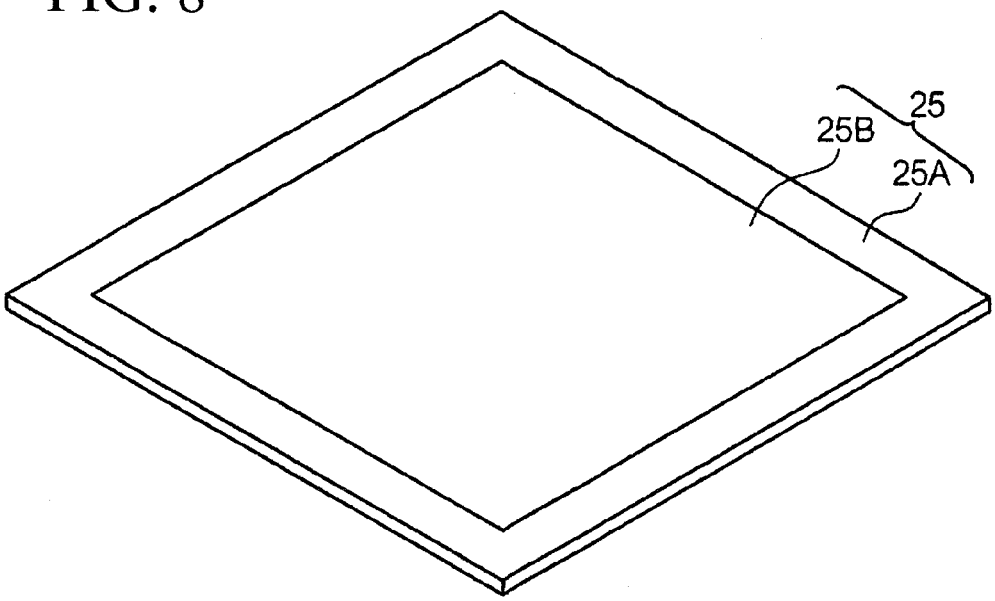
FIG. 8 is a perspective view showing a film electrode substituted for the conductive cloth.

FIG. 8 shows a film electrode 25 having a rectangular shape. The film electrode 25 is formed in such a way that a conductive polymer layer 25B is formed on the surface of a base film 25A composed of a thermoplastic resin.

Figure 9:
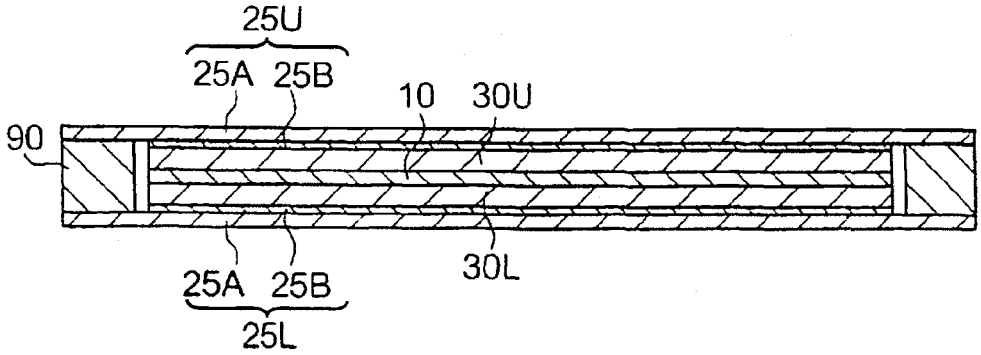
FIG. 9 is a longitudinal sectional view showing the electronic configuration of the electrostatic speaker constituted of a vibrator, elastic members, and film electrodes.

FIG. 9 shows another variation of the electrostatic speaker 1 which uses a pair of film electrodes 25L and 25U instead of the conductive cloths 20L and 20U. First, the film electrode 25L is arranged such that the conductive polymer layer 25B thereof is directed upwardly. Next, the sheet 90 is mounted on the film electrode 25L so as to hold a set of the vibrator 10 and the elastic members 30L and 30U inside of the rectangular frame thereof; then, the film electrode 25U is mounted on the sheet 90 and the elastic member 30U such that the conductive polymer layer 25B thereof is directed downwardly. Thereafter, the sheet 90 is pressed and heated so as to adhere the film electrodes 25U and 25L together via the sheet 90.

In the aforementioned structure, it is possible to prevent the constituent elements 10, 25, and 30 from being separated and shifted in position; and it is possible to prevent the vibrator 10 and the elastic members 30 from being exposed externally. In addition, it is possible to appropriately set the distance between the film electrodes 25 by adjusting the thickness of the sheet 90. Furthermore, it is possible to manufacture the electrostatic speaker 1 with each because all the constituent elements are restrained in position by simply pressing and heating the sheet 90.

It is possible to replace the sheet 90 with the adhesive agent, which is applied to multiple points of the constituent elements, which are thus adhered together and are restrained in position. When multiple points of the adhesive agent are each formed to slightly project from the constituent elements with certain thickness, space may be formed between the constituent elements. That is, the adhesive agent can be used as a spacer (or spacers).

Moreover, a quilting member is attached to the conductive cloth 20U at a prescribed position opposite to the elastic member 30U, while another quilting members is attached to the conductive cloth 20L at a prescribed position opposite to the elastic member 30L. The quilting members are woven together with the vibrator 10, the conductive cloths 20, and the elastic members 30. In this structure, even when the electrostatic speaker 1 is bent or folded, the quilting members may expand so as to press the conductive cloths 20, thus prevent the spaces between the vibrator 10 and the conductive cloths 20 from being unexpectedly broadened.

Lastly, the present invention is not necessarily limited to the foregoing embodiment and variations, which can be further modified in a variety of ways within the scope of the invention as defined in the appended claims.

What is claimed is:

1. An electrostatic speaker comprising:

a first electrode corresponding to a cloth formed using conductive fibers;

a second electrode corresponding to a cloth formed using conductive fibers, which is positioned opposite to the first electrode with a prescribed distance therebetween;

a vibrator having a conductive property, which is positioned between the first electrode and the second electrode;

a first elastic member having an insulating property, elasticity, and acoustic transmittance, which is positioned between the vibrator and the first electrode;

a second elastic member having an insulating property, elasticity, and acoustic transmittance, which is positioned between the vibrator and the second electrode; and at least one restraint member for restraining the first electrode, the first elastic member, the vibrator, the second elastic member, and the second electrode in position, wherein the at least one restraint member holding the first electrode and the second electrode together at a plurality of locations.

2. An electrostatic speaker according to claim 1, wherein the restraint member corresponds to a plurality of strings for weaving the first electrode, the first elastic member, the vibrator, the second elastic member, and the second electrode together.

3. An electrostatic speaker according to claim 1, wherein the first electrode and the second electrode are formed by weaving conductive strings.

4. An electrostatic speaker according to claim 1, wherein the first electrode and the second electrode are woven with flexibilities.

5. An electrostatic speaker according to claim 4, wherein the first electrode and the second electrode are woven together while being stretched.

6. An electrostatic speaker according to claim 1, wherein an area of the first electrode is larger than an area of the vibrator, and an area of the second electrode is larger than the area of the vibrator.

7. An electrostatic speaker according to claim 1, wherein the restraint member corresponds to a plurality of tag-pins which run through the first electrode, the first elastic member, the vibrator, the second elastic member, and the second electrode.

8. An electrostatic speaker according to claim 1, wherein the restraint member is a sheet composed of a thermoplastic resin, which is positioned between the first electrode and the vibrator and between the vibrator and the second electrode, and wherein when the sheet is melted, the first electrode and the vibrator are adhered together, while the vibrator and the second electrode are adhered together.

9. An electrostatic speaker according to claim 1, further comprising:

a first quilting member which is positioned opposite to the first elastic member in view of the first electrode; and a second quilting member which is positioned opposite to the second elastic member in view of the second electrode, wherein the first quilting member and the second quilting member are restrained by the restraint member.

10. An electrostatic speaker according to claim 1, wherein the restraint member corresponds to an adhesive agent, which is applied to the first electrode, the first elastic member, the vibrator, the second elastic member, and the second electrode at multiple points.

11. An electrostatic speaker comprising:

a first electrode composed of a conductive film;

a second electrode composed of a conductive film, which is positioned opposite to the first electrode with a prescribed distance therebetween;

a vibrator having a conductive property, which is positioned between the first electrode and the second electrode;

a first elastic member having an insulating property, elasticity, and acoustic transmittance, which is positioned between the vibrator and the first electrode;

a second elastic member having an insulating property, elasticity, and acoustic transmittance, which is positioned between the vibrator and the second electrode; and a restraint member for restraining the first electrode, the first elastic member, the vibrator, the second elastic member, and the second electrode in position, wherein at least one restraint member holding the first electrode and the second electrode together at a plurality of locations.

12. An electrostatic speaker comprising:

a first electrode comprising a conductive film;

a second electrode comprising a conductive film, which is positioned opposite to the first electrode with a prescribed distance therebetween;

a vibrator having a conductive property, which is positioned between the first electrode and the second electrode;

a first elastic member having an insulating property, elasticity, and acoustic transmittance, which is positioned between the vibrator and the first electrode;

a second elastic member having an insulating property, elasticity, and acoustic transmittance, which is positioned between the vibrator and the second electrode; and a restraint member for restraining the first electrode, the first elastic member, the vibrator, the second elastic member, and the second electrode in position, wherein at least one restraint member holding the first electrode and the second electrode together at a plurality of locations.

* * * * *